US010428809B2

(12) United States Patent
Kawamori et al.

(10) Patent No.: US 10,428,809 B2
(45) Date of Patent: Oct. 1, 2019

(54) PUMPING SYSTEM

(71) Applicant: SUGINO MACHINE LIMITED, Uozu, Toyama Prefecture (JP)

(72) Inventors: Yoshiteru Kawamori, Uozu (JP); Yukinobu Takata, Namerikawa (JP); Akinori Shibata, Shimotsuga-gun (JP)

(73) Assignee: SUGINO MACHINE LIMITED, Uozu (JP)

( * ) Notice: Subject to any disclaimer, the term of this patent is extended or adjusted under 35 U.S.C. 154(b) by 719 days.

(21) Appl. No.: 14/947,754

(22) Filed: Nov. 20, 2015

(65) Prior Publication Data

US 2016/0222950 A1 Aug. 4, 2016

(30) Foreign Application Priority Data

Feb. 4, 2015 (JP) ..... 2015-019841

(51) Int. Cl.
*F04B 17/03* (2006.01)
*F04B 23/02* (2006.01)
(Continued)

(52) U.S. Cl.
CPC ..... *F04B 17/03* (2013.01); *B05B 1/1636* (2013.01); *B05B 15/58* (2018.02); *F04B 23/02* (2013.01);
(Continued)

(58) Field of Classification Search
CPC .. F04B 17/03; F04B 49/08; F04B 2203/0209; F04B 49/065; B05B 15/58; B05B 1/1636; B05B 9/0413
See application file for complete search history.

(56) References Cited

U.S. PATENT DOCUMENTS 5,535,496 A * 7/1996 Sugino ..... B08B 3/02 29/39
2013/0244125 A1* 9/2013 Wake ..... H01M 8/04097 429/415
2013/0293611 A1* 11/2013 Ueshima ..... B41J 2/125 347/12

FOREIGN PATENT DOCUMENTS

EP 0669187 A2 8/1995
JP H07-21145 U 4/1995
(Continued)

OTHER PUBLICATIONS

Jun. 22, 2016 Extended Search Report issued in European Patent Application No. 16153622.2.

*Primary Examiner* — Charles G Freay
*Assistant Examiner* — Lilya Pekarskaya
(74) *Attorney, Agent, or Firm* — Oliff PLC

(57) ABSTRACT

To keep a discharge pressure or a discharge flow rate of a pumping system that jets a fluid from a nozzle selected from a plurality of nozzles a set value every selected nozzle. A pumping system that jets the fluid from the nozzle selected from the plurality of nozzles is provided with: a piston pump as a positive-displacement pump; a permanent-magnet type synchronous motor as a rotational speed variable drive unit; a turret device as selecting arrangement; a discharge pipe; the nozzle; a controller that controls the rotational speed of the drive unit; a storage that stores control parameters and a target value of the discharge pressure corresponding to each nozzle; and a pressure sensor, wherein the controller controls the rotational speed of the drive unit by feeding back the discharge pressure using the control parameters corresponding to the selected nozzle to match the discharge pressure with the target value.

9 Claims, 6 Drawing Sheets

(51) Int. Cl.

| | |
|---|---|
| ***F04B 49/06*** | (2006.01) |
| ***F04B 49/08*** | (2006.01) |
| ***B05B 1/16*** | (2006.01) |
| ***B05B 15/58*** | (2018.01) |
| *B05B 9/04* | (2006.01) |

(52) U.S. Cl.
CPC ..... *F04B 49/065* (2013.01); *F04B 49/08* (2013.01); *B05B 9/0413* (2013.01); *F04B 2203/0209* (2013.01); *F04B 2205/05* (2013.01)

(56) References Cited

FOREIGN PATENT DOCUMENTS

| | | | |
|---|---|---|---|
| JP | H08-90365 | A | 4/1996 |
| JP | 2001-082346 | A | 3/2001 |
| JP | 2002-122254 | A | 4/2002 |
| JP | 2010-014094 | A | 1/2010 |

* cited by examiner

FIG. 4

60

| n (62) | $P_0$ (64) | $K_P$ (65) | $T_I$ (66) | $T_D$ (67) | $C_1$ (68) | $f_{MAX}$ (69) | $f_{MIN}$ (61) | $F_d$ (63) |
|---|---|---|---|---|---|---|---|---|
| 1 | 50 | 230 | 650 | 30 | 3.7 | 65 | 57 | $F_{d1}(f)$ |
| 2 | x | ××× | ××× | ××× | ××× | ××× | ××× | ××× |
| 3 | 10 | ××× | ××× | ××× | ××× | ××× | ××× | ××× |
| 4 | ××× | ××× | ××× | ××× | ××× | ××× | ××× | ××× |
| 5 | ××× | ××× | ××× | ××× | ××× | ××× | ××× | ××× |
| 6 | ××× | ××× | ××× | ××× | ××× | ××× | ××× | ××× |

FIG. 6A

55

| 71 n | 72 $P_0$ |
|---|---|
| 1 | 10 |
| 2 | x |
| 3 | ××× |
| 4 | ××× |
| 5 | ××× |
| 6 | ××× |

FIG. 6B

56

| 73 $P_0$ | 75 $f_{MIN}$ | 76 $f_{MAX}$ |
|---|---|---|
| 10 | 27 | 32 |
| 15 | 29 | 36 |
| 20 | ××× | ××× |
| 25 | ××× | ××× |
| 30 | ××× | ××× |
| 35 | ××× | ××× |
| 40 | ××× | ××× |
| 45 | ××× | ××× |
| 50 | ××× | ××× |
| 55 | ××× | ××× |
| 60 | ××× | ××× |

FIG. 6C

57

| 77 | 78 |
|---|---|
| $K_P$ | 300 |
| $T_I$ | 700 |
| $T_D$ | 50 |
| $C_1$ | ××× |

FIG. 7A

96

| 81 n | 82 TYPE | 83 $d_0$ | 84 $P_0$ |
|---|---|---|---|
| 1 | N1 | 3. 6 | 10 |
| 2 | N2 | 0. 6 | 50 |
| 3 | ••• | ••• | ••• |
| 4 | ••• | ••• | ••• |
| 5 | ••• | ••• | ••• |
| 6 | ••• | ••• | ••• |

FIG. 7B

97

| 85 TYPE | 87 $K_P$ | 88 $T_I$ | 89 $T_D$ | 86 $C_1$ | 91 d |
|---|---|---|---|---|---|
| N1 | $F_{1KP}(d_0, P_0)$ | $F_{1TI}(d_0, P_0)$ | $F_{1TD}(d_0, P_0)$ | $F_{1C1}(d_0, P_0)$ | $F_{dn1}(f, P)$ |
| N2 | $F_{2KP}(d_0, P_0)$ | $F_{2TI}(d_0, P_0)$ | $F_{2TD}(d_0, P_0)$ | $F_{2C1}(d_0, P_0)$ | $F_{dn2}(f, P)$ |
| ••• | ••• | ••• | ••• | ••• | ••• |
| ••• | ••• | ••• | ••• | ••• | ••• |
| ••• | ••• | ••• | ••• | ••• | ••• |

FIG. 7C

98

| 90 n | 92 $K_P$ | 93 $T_I$ | 94 $T_D$ | 99 $C_1$ |
|---|---|---|---|---|
| 1 | 230 | 650 | 30 | 3.7 |
| 2 | 520 | 720 | 25 | 2.4 |
| 3 | ••• | ••• | ••• | ••• |
| 4 | ••• | ••• | ••• | ••• |
| 5 | ••• | ••• | ••• | ••• |
| 6 | ••• | ••• | ••• | ••• |

PUMPING SYSTEM

BACKGROUND

1. Field of the Invention

The present invention relates to a pumping system, especially relates to the control of a pumping system that pressurizes fluid and jets the fluid from a nozzle selected out of a plurality of nozzles.

2. Description of the Related Art

There is a pumping system in which a plurality of nozzles are connected to a pump via selecting arrangement and which jets fluid discharged by the pump from the nozzle selected by the selecting arrangement. Such a pumping system is used for a cleaning device disclosed in JP-A No. H8-90365 for example. In the cleaning device disclosed in JP-A No. H8-90365, a plurality of nozzles are arranged on the upside of a turret which is selecting arrangement. Fluid discharged by the pump is jetted from one nozzle selected by the selecting arrangement.

The discharge pressure of a positive-displacement pump is determined by the rotational speed (the speed of rotation per unit time) of the positive-displacement pump, the contour of a jet of the nozzle and the jet hole diameter of the nozzle. When selected nozzles are switched, fluid is jetted with pressure according to the newly selected nozzle according to a curve showing relation between the discharge pressure and the discharge flow rate of the pump.

When cleaning, chipping, deburring or other work is performed using a pumping system, the discharge flow rate or the discharge pressure of a pump and acquired effect closely relate. Accordingly, when a plurality of works are performed using the plurality of nozzles, it is desirable that optimum discharge pressure or optimum discharge flow rate is selected every work.

An object of the present invention is first to keep the discharge pressure or the discharge flow rate of the fluid in a pumping system that jets from a nozzle selected out of a plurality of nozzles at a value set every selected nozzle.

A nozzle is gradually abraded by jetted fluid, a jet hole diameter is extended, and the contour of the jet is deteriorated. As detergency and deburring capacity are influenced by discharge pressure, the contour of the jet and discharge flow rate, the abraded nozzle is replaced. A conventional type pumping system is configured so that a pressure-relief valve is provided to a discharge opening of a pump and discharge pressure is kept a value constant by the pressure-relief valve. When the discharge pressure is deteriorated, the relief pressure of the pressure-relief valve is regulated and when predetermined discharge pressure cannot be held by the closure of the pressure-relief valve, a nozzle is replaced. However, the time of replacement cannot be estimated.

The object of the present invention is second to verify a situation of abrasion of a nozzle and inform the proper time to replace the nozzle.

SUMMARY

In view of the above-mentioned objects, the present invention is based upon a pumping system that pressurizes fluid and jets the fluid from a nozzle selected out of a plurality of nozzles. The pumping system is provided with: a positive-displacement pump having a discharge opening for discharge the fluid; a rotational speed variable drive unit that drives the positive-displacement pump; selecting arrangement equipped with an inlet of the fluid and a plurality of outlets, the selecting arrangement providing communication between the inlet and any of the plurality of outlets; a discharge pipe providing communication between the discharge opening and the inlet; the nozzle communicating with the outlet; a controller that controls the rotational speed of the drive unit; a storage that stores control parameters used for the control of the rotational speed and a target value of a discharge characteristic which is a discharge pressure or a discharge flow rate of the positive-displacement pump corresponding to each of the plurality of nozzles; and a sensor which is provided to the discharge pipe and measures the discharge characteristic of the positive-displacement pump. The controller feeds back the discharge characteristic using the control parameters corresponding to the nozzle selected by the selecting arrangement to match the discharge characteristic with the target value and the controller controls the rotational speed of the derive unit.

According to the above-mentioned configuration, the rotational speed of the pump is controlled by feeding back the discharge characteristic, and the discharge pressure or the discharge flow rate of the pump can be matched with the target value set every nozzle.

It is desirable that the present invention is provided with an exhaust valve provided to a pipe branched from the discharge pipe and the controller keeps the rotational speed of the drive unit preset idling rotational speed when the exhaust valve is opened or when no nozzle is selected the selecting arrangement.

According to the above-mentioned configuration, when the exhaust valve is opened or when no nozzle is selected by the selecting arrangement, fluid uplifted by the positive-displacement pump is exhausted from the exhaust valve and the rotational speed of the positive-displacement pump for a while is converted to idling rotational speed. If rotational speed lower than rotational speed when the nozzle is selected is selected for the idling rotational speed, the power consumption of the pump when no fluid is jetted from the nozzle can be reduced.

It is desirable that the present invention is provided with a frequency converter that converts a frequency of ac power supplied to the drive unit, the drive unit is an a.c. motor, and the controller performs PID control of the frequency of the ac power supplied by the frequency converter based upon a deviation between the discharge characteristic and the target value. In this case, the control parameter includes a proportional gain, an integral time and a derivative time corresponding to a type of nozzles and a jet hole diameter of the nozzle (a reference jet hole diameter).

According to the above-mentioned configuration, feedback control having satisfactory responsibility can be realized with the simple configuration.

In the present invention, it is desirable that the positive-displacement pump is a gear pump or a piston pump and the drive unit is a permanent-magnet type synchronous motor.

According to the above-mentioned configuration, as the permanent-magnet type synchronous motor has satisfactory follow-up of rotational speed for a frequency of a power source, a pumping system having better responsibility can be acquired. Besides, as the permanent-magnet type synchronous motor has high energy efficiency, the pumping system having higher mechanical efficiency can be acquired.

It is desirable that the present invention is provided with a warning unit that issues warning related to the nozzle and when the rotational speed of the drive unit exceeds a preset upper limit rotational speed of the nozzle selected by the selecting arrangement or when the rotational speed of the drive unit is equal to the upper limit rotational speed, the warning unit issues warning related to the nozzle selected by the selecting arrangement.

According to the above-mentioned configuration, the warning unit suitably issues warning or can persuade the replacement of nozzles according to the abrasion loss of the nozzle. That is, the warning unit checks a situation of abrasion of the nozzle and can inform of suitable timing to replace the nozzle. In this case, the warning unit means a warning generator, a warning display, an outside alarm signal oscillator and other device provided with warning means.

It is desirable that the present invention is provided with a display unit that displays information, the storage stores information for relating the rotational speed of the drive unit and the jet hole diameter of the nozzle every nozzle, the controller acquires the rotational speed of the drive unit, estimates the jet hole diameter of the nozzle equivalent to the acquired rotational speed based upon the relating information, and the controller instructs the display unit to display the estimated jet hole diameter.

The nozzle is abraded according to the jet of fluid and the jet hole diameter of the nozzle is gradually extended, however, according to the above-mentioned configuration, a user can verify the estimated value of the current jet hole diameter of the nozzle. That is, the user checks a situation of the abrasion of the nozzle and can know suitable timing to replace the nozzle. Therefore, the user makes a plan for replacing the nozzle beforehand and can prevent the quality of work such as cleaning from being deteriorated.

In the present invention, it is desirable that the controller performs feedback control for controlling the rotational speed of the drive unit by feeding back the discharge characteristic so as to match the discharge characteristic with the target value and feedforward control for controlling the rotational speed of the drive unit according to the target value.

According to the above-mentioned configuration, the feedforward control is made to eliminate a delay of a response of the discharge characteristic at the beginning of operation. Besides, the feedforward control compensates to match the discharge characteristic with the target value in activating the positive-displacement pump for example and in a transient state in switching used nozzles.

In the present invention, it is desirable that the target value varies according to the preset order of cleaning.

According to the above-mentioned configuration, even if the target value is suitably changed according to the order of cleaning programmed by a numerical control program for example, the regulation of the discharge characteristic having satisfactory follow-up is possible.

In the present invention, it is desirable that the control parameter is acquired based upon the type of the nozzle, the reference jet hole diameter of the nozzle and the target value and is stored in the storage.

According to the above-mentioned configuration, even if the type of the nozzle connected to each outlet of the selecting arrangement and the jet hole diameter are changed, a controllable pumping system can be provided by only setting the type of the nozzle, the reference jet hole diameter of the nozzle and the target value.

According to the present invention, the discharge pressure or the discharge flow rate of the pumping system that jets from the nozzle selected out of a plurality of nozzles can be kept a value set every selected nozzle.

BRIEF DESCRIPTION OF THE DRAWINGS

Non-limiting and non-exhaustive embodiments of the present embodiments are described with reference to the following FIGURES, wherein like reference signs refer to like parts throughout the various views unless otherwise specified.

FIG. 4 shows control parameters of the pumping system according to the embodiment.

FIGS. 6A, 6B, 6C show control parameters of a pumping system according to a first modification of the embodiment, wherein FIG. 6A shows target pressure for a tool number, FIG. 6B shows an upper limit frequency and a lower limit frequency for the target pressure, and FIG. 6C shows control parameters in PID control.

FIGS. 7A, 7B, 7C show control parameters of a pumping system according to a second modification of the embodiment, wherein FIG. 7A shows set values for a tool number, FIG. 7B shows functions of control parameters for a type of a nozzle, and FIG. 7C shows the control parameters in PID control for the tool number.

DETAILED DESCRIPTION

Referring to FIGS. 1 to 5, an embodiment of the present invention will be described in detail below.

Embodiment (Configuration)

Figure 1:
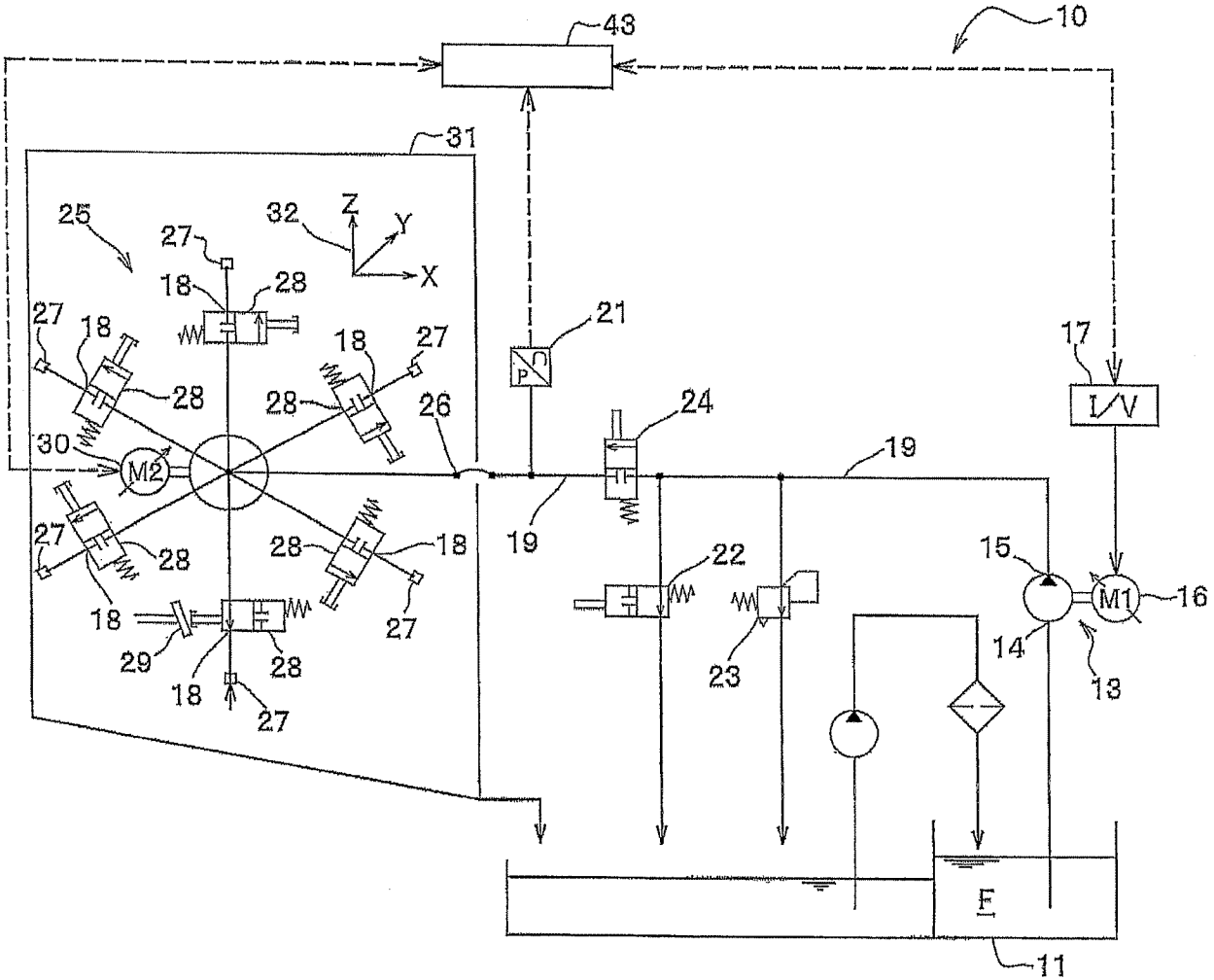
FIG. 1 is a schematic diagram showing a pumping system according to an embodiment.

FIG. 1 shows a pumping system 10 in this embodiment of the present invention.

As shown in FIG. 1, the pumping system 10 pressurizes fluid F and jets the fluid F from a nozzle 27 selected out of a plurality of nozzles 27. The fluid F is stored in tank equipment 11. In this case, the fluid F is water or aqueous solution including a cleaner, an antiseptic, a rust preventive or an other additive. The tank equipment 11 is provided with two-vessel type filtration equipment. As the tank equipment 11 is commonly used for a washer and a cutter, its detailed description is omitted.

The pumping system 10 is provided with a positive-displacement pump. In this embodiment, the positive-displacement pump is a piston pump 13 which is provided with a plurality of plungers, which sucks the fluid F from an intake opening 14 by reciprocating the plungers and which discharges the fluid F from a discharge opening 15. Discharge pressure (a discharge characteristic) can be set to a high value by using the piston pump 13. Therefore, the pumping system 10 can be suitably utilized for cleaning a mechanical part, deburring work, cleaning a polymerization tank or a container, peeling coating or chipping concrete.

Discharge pressure P [MPa] is determined according to a jet hole diameter of the nozzle 27 that jets the fluid F and the rotational speed N [$min^{-1}$] of the positive-displacement pump by using the positive-displacement pump. Action that as the rotational speed N rises, the discharge pressure P increases and as the jet hole diameter of the nozzle 27 increases, the discharge pressure P decreases occurs.

In place of the piston pump 13, a gear pump and another positive-displacement pump can be used. The pumping system 10 in this embodiment is provided with one piston pump 13, however, the pumping system 10 may be also provided with a plurality of positive-displacement pumps.

The pumping system 10 is provided with a drive unit that varies rotational speed for driving the positive-displacement pump and a frequency converter that converts a frequency of ac power supplied to the drive unit. In this embodiment, the drive unit of the piston pump 13 as the positive-displacement pump is a permanent-magnet type synchronous motor 16. Besides, in this embodiment, the frequency converter is an inverter 17. The inverter 17 generates ac power having an arbitrary frequency from an ac power source. As the pumping system 10 is provided with the inverter 17 and the permanent-magnet type synchronous motor 16, a response for the rotational speed of the piston pump 13 is accelerated. A configuration for controlling the rotational speed of the piston pump 13 is simply acquired at a low price.

In place of the permanent-magnet type synchronous motor 16, an electromagnet synchronous motor, other ac synchronous motor or a dc synchronous motor or an induction motor can be used. In place of the inverter 17 and the permanent-magnet type synchronous motor 16, a stepping motor or a servo motor can be utilized. When the stepping motor or the servo motor is used, a delay of the control of the inverter 17 is canceled because the inverter 17 is not used and a faster response is enabled.

The pumping system 10 is provided with selecting arrangement equipped with an inlet 26 of the fluid F and a plurality of outlets 18. The inlet 26 is communicated with any of the plurality of outlets 18 through the selecting arrangement. In this embodiment, the selecting arrangement is a turret device 25. The turret device 25 indexes one turret face out of a plurality of turret faces to which each nozzle 27 is attached by a servo motor 30. The turret device 25 is numerically controlled by an orthogonal axis moving device 32 including XYZ axes. A lever operation type valve 28 is provided to the turret device 25 corresponding to each turret face. A lever of the valve 28 provided corresponding to the indexed turret face is pressed by a fixed cam follower 29. Then, the fluid F supplied from the inlet 26 of the turret device 25 is jetted from the nozzle 27 attached to the indexed turret face via the outlet 18.

For indexing the turret face in the turret device 25 as the selecting arrangement, a roller gear cam, a parallel cam or other index cam mechanism can be utilized in place of the servo motor 30. The selecting arrangement is provided with valves 28 of the same number as the number of nozzles 27 and can take various configurations in which inflow inlets of respective valves 28 are connected to the inlet 26 of the selecting arrangement. For example, in the selecting arrangement, respective valves 28 may be also opened/closed according to an instruction from a controller 43, the valves 28 are arranged in series, and the valve 28 to be opened may be also selected by a rotated camshaft. For the latter selecting arrangement, selecting arrangement disclosed in Japanese Patent No. 3812879 for example can be utilized.

The discharge opening 15 of the piston pump 13 is communicated with the inlet 26 of the turret device 25 through a discharge pipe 19.

A pressure sensor 21 is provided to the discharge pipe 19, measures discharge pressure P of the piston pump 13, and outputs a measured result to the controller 43.

A pressure-relief valve 23 is provided to a pipe branched from the discharge pipe 19, when the discharge pressure P exceeds predetermined pressure $P_S$ and the pressure-relief valve 23 lets the fluid F go to the tank equipment 11 so as to keep the discharge pressure P equal to or below the pressure $P_S$. The pressure $P_S$ is set so that it is slightly higher than the ordinarily used discharge pressure P and is lower than the compressive strength (a pressure value) of the piston pump 13, the discharge pipe 19, the pressure sensor 21 and the turret device 25.

An exhaust valve 22 is provided to a pipe branched from the discharge pipe 19. The effective sectional area of a passage of the exhaust valve 22 is greatly larger than that of the nozzle 27. As the effective sectional area of the passage of the exhaust valve 22 is large, pressure in the discharge pipe 19 rapidly decreases when the exhaust valve 22 is opened. All the fluid F discharged by the piston pump 13 returns to the tank equipment 11 through the exhaust valve 22 when the exhaust valve 22 is opened.

A cleaning valve 24 is provided to the downstream side of a branch point with the exhaust valve 22 of the discharge pipe 19. The cleaning valve 24 is opened when the exhaust valve 22 is closed and is closed when the exhaust valve 22 is opened. All the fluid F is supplied to the turret device 25 when the cleaning valve 24 is opened.

It is desirable that the cleaning valve 24 is installed, however, the cleaning valve 24 is not necessarily essential.

Moreover, the pumping system 10 is provided with the controller 43. The controller 43 controls so that the discharge pressure P of the piston pump 13 is matched with a target value (hereinafter also called target pressure $P_O$) via the inverter 17 according to discharge pressure P detected by the pressure sensor 21.

Figure 2:
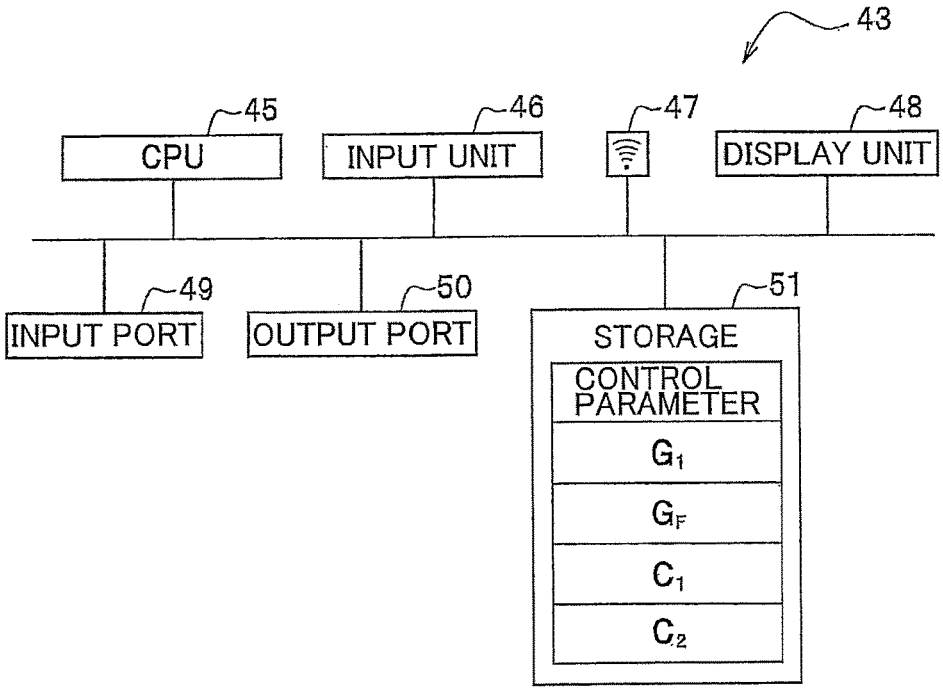
FIG. 2 is a schematic diagram showing a controller of the pumping system according to the embodiment.

FIG. 2 shows the configuration of the controller 43. As shown in FIG. 2, the controller 43 is provided with a CPU 45, an input unit 46, a warning unit 47, a display unit 48, an input port 49, an output port 50 and a storage 51, and these are connected via a bus. The controller 43 includes a numerical control unit. The CPU 45 is provided with a function as a control unit that controls the rotational speed of the permanent-magnet type synchronous motor 16 as a drive unit. The input unit 46 is a unit for directly inputting data such as a keyboard, a ten key pad and a mouse. The warning unit 47 is a speaker that informs an alarm in voice or a unit that displays warning. The display unit 48 displays information such as pressure, a control parameter and a set value and a liquid crystal panel can be used. The input unit 46, the warning unit 47 and the display unit 48 may be also configured as one touch panel. The input port 49 receives a signal transmitted from the servo motor 30, the pressure sensor 21 and other attachment. The output port 50 transmits a signal to the inverter 17, the servo motor 30, the orthogonal axis moving device 32 and other component. The storage 51 stores a control parameter related to each nozzle 27, a transfer function, a numerical control program and other data. The details of the control parameter will be described later. The control parameter and the transfer function are input via the input unit 46 or the input port 49 and are stored in the storage 51. The controller 43 feeds back the discharge pressure P utilizing the control parameter and the transfer function respectively stored in the storage 51 and controls a frequency of ac power supplied to the piston pump 13. As described later, in this embodiment, PID control is used for feedback control.

Figure 3:
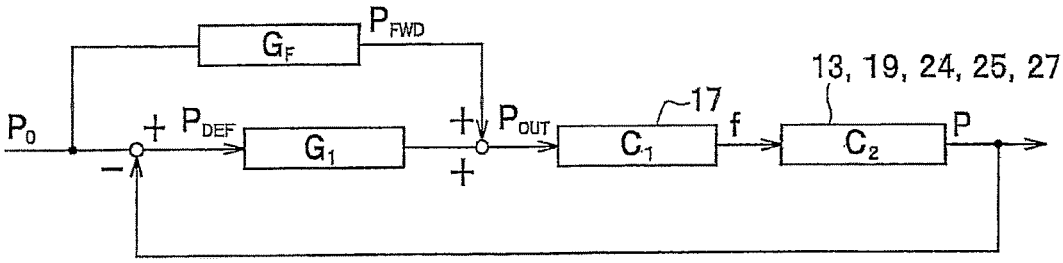
FIG. 3 is a block diagram showing a control method of the pumping system according to the embodiment.

FIG. 3 is a block diagram showing a control system. The rotational speed N of the permanent-magnet type synchronous motor 16, that is, the rotational speed N of the piston pump 13 is determined by a load of the piston pump 13 and a frequency f. Accordingly, the controller 43 feeds back the discharge pressure P and controls the rotational speed N of the piston pump 13. The CPU 45 determines target pressure $P_O$ corresponding to a selected tool number n based upon information stored in the storage 51. The CPU 45 commands pressure $P_{OUT}$ to the inverter 17 via the output port 50.

When the fluid F is jetted from the nozzle 27, pressure P in the discharge pipe 19 (the discharge pressure P of the piston pump 13) increases according to the jet hole diameter of the nozzle 27 and the rotation speed of the piston pump 13. This pressure P is detected by the pressure sensor 21 and is transmitted to the CPU 45 of the controller 43 via the input port 49. The CPU 45 operates deviation $P_{DEF}$ between the current pressure P and target pressure $P_O$. PID compensation is operated so that the deviation $P_{DEF}$ is 0. Feedback compensation is acquired by operating PID compensation with a proportional gain $K_P$ determined every nozzle, integral time $T_I$ and derivative time $T_D$.

An object of control is the inverter 17, the permanent-magnet type synchronous motor 16 that drives the piston pump 13 and the nozzle 27 of a tool number n selected by the turret device 25. The inverter 17 converts the pressure $P_{OUT}$ to a frequency f [$s^{-1}$]. A transfer function in which the inverter 17 converts received pressure $P_{OUT}$ to the frequency f is represented as a constant $C_1$.

The piston pump 13 is driven by ac power of the frequency f. The rotational speed N of the piston pump 13 is determined by the frequency f. That is, in the pumping system 10 in this embodiment, the rotational speed N of the piston pump 13 is controlled by controlling the frequency f. The discharge pressure P is determined by the rotational speed N of the piston pump 13 and degree of an opening indicated by the jet hole diameter of the nozzle 27. The piston pump 13 is rotated by the ac power of the frequency f generated by the inverter 17, the piston pump 13 pressurizes the fluid F, and the fluid F is jetted from the selected nozzle 27. A transfer function representing relation between the frequency f of the ac power and the generated discharge pressure P can be represented as a constant $C_2$ showing the resistance of the pipe for the rotational speed N of the piston pump 13.

In this case, $C_1$ and $C_2$ are determined by a type of the nozzle, a reference jet hole diameter $d_O$ of the nozzle and the target pressure $P_O$. When respective transfer functions of PID compensation and feedforward compensation are $G_1$ and $G_F$, a transfer function of the control system is expressed in a formula 1. The reference jet hole diameter $d_O$ of the nozzle is an initial jet hole diameter which is a set value.

[Formula 1]

$$G = \frac{C_1 C_2 (G_1 + G_F)}{1 + G_1 C_1 C_2} \tag{1}$$

In this case, $G_1$ is expressed in a formula 2.

[Formula 2]

$$G_1 = K_p\left(1 + \frac{1}{T_I s} + T_D s\right) \tag{2}$$

Feedforward control is performed for target pressure $P_O$ and compensation for a pressure dead zone area which is an object of control, that is, the cancellation of a response delay of pressure at the beginning of operation is made. Besides, in feedfoward control, in a transient state when the piston pump 13 is activated and when used nozzles 27 are switched for example, compensation is made to match with a target value.

FIG. 4 shows an example of the configuration of data such as a control parameter stored in the storage 51 in a table 60. In this embodiment, the tool number n corresponds to a turret number appended every turret face of the turret device 25. It is supposed that for the tool number n, a type of the attached nozzle 27 and the reference jet hole diameter $d_O$ are determined and target pressure $P_O$ corresponding to the attached nozzle 27 is also preset.

The table 60 shows values of data such as control parameters for the tool number n in a column 62. A column 64 shows the target pressure $P_O$ [MPa] corresponding to the tool number n. When numerals are input in the column 64, they show the target pressure $P_O$. When a specific character (for example, x) is input in the column 64, the specific character shows that no nozzle 27 is provided at the tool number n. A column 65 shows the proportional gain $K_P$ which is a parameter of PID control corresponding to the tool number n. A column 66 shows the integral time $T_I$ corresponding to the tool number n. A column 67 shows the derivative time $T_D$ corresponding to the tool number n. A column 68 shows the constant $C_1$ which is the transfer function. A column 69 shows an upper limit frequency $f_{MAX}$ [$s^{-1}$] corresponding to the tool number n and a column 61 shows a lower limit frequency $f_{MIN}$ [$s^{-1}$] corresponding to the tool number n. A column 63 shows functions Fd1(*f*), Fd2(*f*), . . . using the current frequency f for an argument for operating a converted jet hole diameter d which is an estimated value of the current jet hole diameter of the nozzle. The CPU 45 receives the frequency f from the inverter 17 and estimates the converted jet hole diameter d based upon the frequency f and the functions in the column 63. As the frequency f minutely oscillates at width to a certain extent, a calculated value of the converted jet hole diameter d also oscillates. Then, it is desirable that as to the converted jet hole diameter d which is an estimated value, a moving average is calculated and an oscillating component is absorbed.

When a stepping motor or a servo motor is used in place of the permanent-magnet type synchronous motor 16 and the inverter 17, it need scarcely be said that data related to rotational speed is used in place of data related to the frequency. Naturally, the controller 43 can be configured in a state in which the controller 43 is divided into a first controller (for example, a numerical control unit) that controls the whole pumping system 10 and a second controller (for example, a sequencer) that performs PID control and instructs the inverter 17.

Besides, the inverter 17 outputs the frequency f according to the input of the pressure $P_{OUT}$, however, the CPU 45 of the controller 43 once converts the pressure $P_{OUT}$ to a current value i and the inverter 17 may also output the frequency f according to the input of the current value i.

In place of the input of the specific character (for example, x) in the column 64, a column showing whether the nozzle 27 is attached or not for the tool number n may be also separately provided. At this time, in the column, when the nozzle 27 is attached, 1 is input and when no nozzle 27 is attached, 0 is input.

Further, the column 69, the column 61 and the column 63 may be also suitably omitted. When the column 63 is provided, the columns 61, 69 that provide a normal range of the frequency f are not required because the warning unit 47 can issue warning based upon the converted jet hole diameter d. Furthermore, as the jet of the nozzle 27 is extended according to use, the frequency f increases according to it. Therefore, the column 61 may be also normally omitted. Furthermore, in the case of a configuration that no warming is issued to the frequency f, the columns 61, 69 are not required to be provided.

Figure 5:
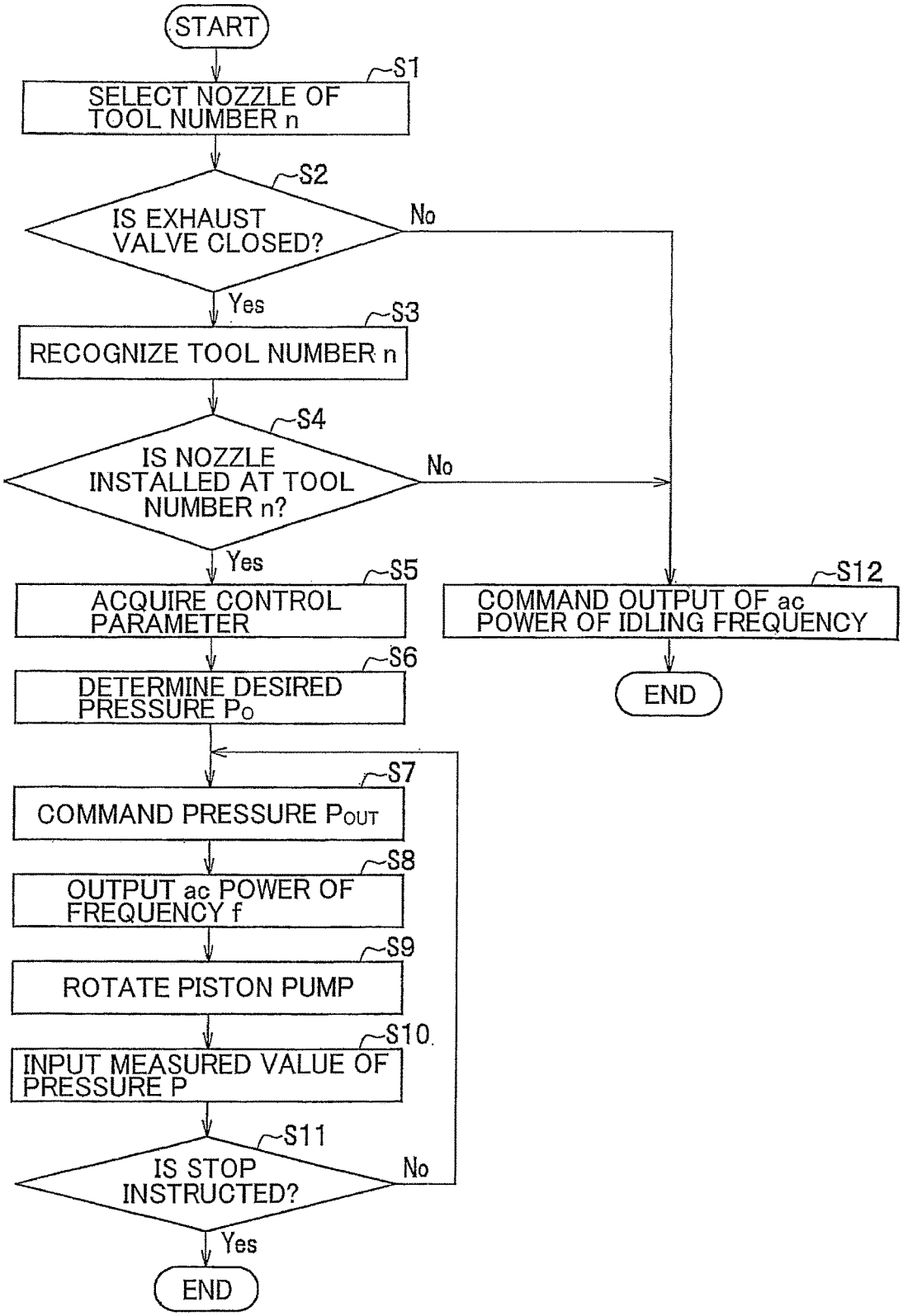
FIG. 5 is a flowchart showing the control method of the pumping system according to the embodiment.

FIG. 5 shows a method of controlling the pumping system 10 configured as described above. Contents of a flowchart shown in FIG. 5 are stored in the storage 51 as a program. The CPU 45 of the controller 43 selects the nozzle 27 that jets out of the plurality of nozzles 27 with the tool number n using the turret device 25 according to a numerical control program in the orthogonal axis moving device 32 (S1). When the fluid F is jetted from the nozzle 27, the CPU 45 of the controller 43 instructs the exhaust valve 22 to close and instructs the cleaning valve 24 to open. The CPU 45 judges whether the exhaust valve 22 is closed or not (S2). When the exhaust valve 22 is open (No in S2), the process proceeds to a step S12 described later.

When the pumping system 10 is provided with the cleaning valve 24, the step S2 may be also replaced with judgment of whether the cleaning valve 24 is open or not.

When the exhaust valve 22 is closed (Yes in S2), the CPU 45 recognizes the tool number n which is a number corresponding to the selected nozzle 27 based upon an output signal from the servo motor 30 (S3). The CPU 45 judges whether the nozzle 27 is provided to the selected tool number n based upon the table 60 (see FIG. 4) or not (S4). When the nozzle 27 is provided to the selected tool number n (Yes in S4), the CPU 45 acquires a control parameter fitted to the recognized tool number n from the table 60 (S5). The CPU 45 determines target pressure $P_O$ which is a target value of the discharge pressure P of the piston pump 13 based upon the table 60 (S6). The CPU 45 commands the inverter 17 to output pressure $P_{OUT}$ via the output port 50 (S7). The inverter 17 transmits ac power of the frequency f to the piston pump 13 based upon the pressure $P_{OUT}$ (S8). The piston pump 13 is driven by the permanent-magnet type synchronous motor 16 and is rotated at predetermined rotational speed N (S9). The piston pump 13 sucks the fluid F from the intake opening 14, pressurizes the fluid F, and discharges it from the discharge opening 15. The pressurized fluid F is jetted from the nozzle 27 of the tool number n via the discharge pipe 19 and the turret device 25. The pressure sensor 21 measures the pressure P of the fluid F in the discharge pipe 19. The pressure P is equivalent to the discharge pressure P of the piston pump 13. A measured value of the pressure P is input to the controller 43 via the input port 49 from the pressure sensor 21 (S10). In a step S11, it is judged whether an instruction to stop the pumping system 10 is made or not. When no instruction to stop the pumping system 10 is made (No in S11), the CPU 45 operates deviation $P_{DEF}$ between the measured pressure P and target pressure $P_O$ and calculates the pressure $P_{OUT}$ which is a corrected value according to the deviation $P_{DEF}$ according to each factor acquired from the table 60 (see FIG. 4) and the transfer function. The CPU 45 instructs the inverter 17 to output the pressure $P_{OUT}$ which is the corrected value (S7).

When the CPU 45 of the controller 43 feeds back the measured discharge pressure P and controls the rotational speed N of the piston pump 13, the discharge pressure P of the piston pump 13 can be matched with the target pressure $P_O$ independent of degree of the abrasion of the nozzle 27.

When the exhaust valve 22 is open in the step S2 (No in S2), the CPU 45 of the controller 43 instructs the inverter 17 to output ac power of an idling frequency $f_{IDL}$ which is a preset and input frequency and rotates the piston pump 13 at idling rotational speed $N_{IDL}$ corresponding to the idling frequency $f_{IDL}$ (S12). At this time, the CPU 45 of the controller 43 performs no feedback control of the frequency f according to the measured discharge pressure P.

In this case, when the pumping system 10 is provided with the cleaning valve 24, the CPU 45 of the controller 43 instructs the exhaust valve 22 to open prior to the closure of the cleaning valve 24.

In the step S4, when it is judged that no nozzle 27 is provided at the selected tool number n (No in S4), the CPU 45 also similarly executes the step S12.

The warning unit 47 issues warning when the frequency f of ac power output from the inverter 17 is lower than the lower limit frequency $f_{MIN}$ (see the column 61 in the table 60 and FIG. 4) or is equal to the lower limit frequency $f_{MIN}$ or when the frequency f of ac power exceeds the upper limit frequency $f_{MAX}$ (see the column 69) or is equal to the upper limit frequency $f_{MAX}$.

According to the above-mentioned embodiment, as the inverter 17 and the permanent-magnet type synchronous motor 16 are used for driving the piston pump 13, a controlled variable is the frequency f of supplied ac power and a value equivalent to the frequency f is used for a control parameter. However, when a servo motor or a stepping motor is used for driving the piston pump 13, a controlled variable is rotational speed and the control parameter is replaced with a value equivalent to the rotational speed. In this case, the transfer function $C_1$ which is a constant represents a servo amplifier that receives pressure and generates a power supply pulse string equivalent to rotational speed.

The pumping system 10 configured as described above in this embodiment pressurizes the fluid F and jets it from the nozzle 27 selected out of the plurality of nozzles 27. The pumping system 10 is provided with the piston pump 13 as a positive-displacement pump equipped with the discharge opening 15 for discharging the fluid F and the permanent-magnet type synchronous motor 16 as a drive unit that can vary rotational speed for driving the piston pump 13. Besides, the pumping system 10 is provided with the turret device 25 as selecting arrangement having the inlet 26 of the fluid F and the plurality of outlets 18 for providing communication between the inlet 26 and any of the plurality of outlets 18, the discharge pipe 19 for providing communication between the discharge opening 15 and the inlet 26, and the nozzle 27 that communicates with the outlet 18. Moreover, the pumping system 10 is provided with the CPU 45 as a control unit that controls the rotational speed N of the permanent-magnet type synchronous motor 16 as a drive unit, the storage 51 that stores the control parameters ($K_P$, $T_I$, $T_D$ and others) used for controlling the rotational speed N of the permanent-magnet type synchronous motor 16 and the target pressure $P_O$ which is a target value of the discharge pressure P of the piston pump 13 corresponding to each of the plurality of nozzles 27, and the pressure sensor 21 which is provided to the discharge pipe 19 and which measures the discharge pressure P of the piston pump 13. The CPU 45 of the controller 43 feeds back the discharge pressure P using the control parameter corresponding to the nozzle 27 selected by the turret device 25 so as to match the discharge pressure P with the target pressure $P_O$ and controls the rotational speed N of the permanent-magnet type synchronous motor 16.

In addition, the pumping system 10 is provided with the exhaust valve 22 provided to the pipe branched from the discharge pipe 19 and the CPU 45 of the controller 43 keeps the rotational speed N of the permanent-magnet type synchronous motor 16 at the idling frequency $f_{IDL}$ corresponding to preset idling rotational speed $N_{IDL}$ when the exhaust valve 22 is opened or when the nozzle 27 is unselected by the turret device 25.

Further, the pumping system 10 is provided with the inverter 17 (the frequency converter) that converts the frequency f of ac power supplied to the permanent-magnet type synchronous motor 16, a drive unit that drives the piston pump 13 is the permanent-magnet type synchronous motor 16 (the ac motor), and the CPU 45 of the controller 43 controls the frequency f of ac power which the inverter 17 supplies to the permanent-magnet type synchronous motor 16 based upon a deviation $P_{DEF}$ between the discharge pressure P and the target pressure $P_O$ by PID control.

Furthermore, the positive-displacement pump provided to the pumping system 10 is the piston pump 13 and the drive unit that drives the piston pump 13 is the permanent-magnet type synchronous motor 16.

Furthermore, the pumping system 10 is provided with the warning unit 47 that issues warning related to the nozzle 27, the frequency f corresponding to the rotational speed N of the permanent-magnet type synchronous motor 16 is preset to the nozzle 27 selected by the turret device 25, and when the frequency f exceeds the upper limit frequency f corresponding to upper limit rotational speed of the permanent-magnet type synchronous motor 16 or when the frequency f is equal to the upper limit frequency $f_{MAX}$, the warning unit 47 issues warning related to the nozzle 27 selected by the turret device 25.

Furthermore, the pumping system 10 is provided with the display unit 48 that displays information and the storage 51 stores the functions Fd1(*f*), Fd2(*f*), . . . which are information for relating the frequency f corresponding to the rotational speed N of the permanent-magnet type synchronous motor 16 and the jet hole diameter of the nozzle 27 every nozzle 27. The CPU 45 of the controller 43 acquires the frequency f corresponding to the rotational speed N of the permanent-magnet type synchronous motor 16, estimates the jet hole diameter of the nozzle 27 equivalent to the acquired frequency f based upon the functions Fd1(*f*), Fd2(*f*), . . . , and instructs the display unit 48 to display it as a converted jet hole diameter d.

Furthermore, the CPU 45 of the controller 43 feeds back the discharge pressure P so as to match the discharge pressure P with the target pressure $P_O$ and performs feedback control for controlling the frequency f corresponding to the rotational speed N of the permanent-magnet type synchronous motor 16 and feedforward control for controlling the frequency f corresponding to the rotational speed N of the permanent-magnet type synchronous motor 16 according to the target pressure $P_O$.

(Effects)

The pumping system 10 in this embodiment can keep the discharge pressure P constant independent of the abrasion loss of the nozzle 27 even if the nozzle 27 is abraded because of use. As PID control is utilized for feedback control, it is gained that time in which the discharge pressure P of the piston pump 13 converges to the target pressure $P_O$ is reduced. As PID control is used, simple and convergent feedback control for a response which requires a complicated system that is difficult to make a function of the pressure of the pumping system 10 is enabled.

As different target pressure $P_O$ is set according to the tool number n and the fluid F is jetted with suitable discharge pressure P for each nozzle 27, work each nozzle 27 is optimized. For example, when the nozzle 27 of the tool number 1 is used, a workpiece is deburred with set pressure in the vicinity of the highest pressure of a pump and when a workpiece is cleaned in water using the nozzle 27 of the tool number 3, the pumping system 10 can jet fluid F with discharge pressure P with which maximum cleaning effect can be expected in the work.

The pumping system 10 is provided with the pressure-relief valve 23 in place of a pressure regulating valve (a relief valve) according to the related art and the discharge pressure P is regulated at the rotational speed N of the piston pump 13. Therefore, the whole quantity of the fluid F jetted by the piston pump 13 is discharged from the nozzle 27. As the problem of discharge from the pressure regulating valve in the related art is settled in this embodiment, energy consumption is reduced.

The nozzle 27 is abraded because of use, however, as the pumping system 10 ordinarily monitors the frequency f of power supply (ac power) corresponding to the rotational speed N of the piston pump 13, the pumping system compares the frequency f and the upper limit frequency $f_{MAX}$ and can issue warning related to the abrasion of the nozzle 27. Therefore, the pumping system 10 suitably issues warning according to the abraded quantity of the nozzle 27 or can persuade to replace the nozzle 27. That is, the pumping system 10 checks a situation of the abrasion of the nozzle 27 and can inform of the right time to replace the nozzle 27.

When the pumping system 10 closes the exhaust valve 22, opens the cleaning valve 24, and when the valve 28 which is a nozzle opening/closing valve is opened, the pressure (the discharge pressure) P of the fluid F discharged by the piston pump 13 starts to rise. As the pumping system 10 use feedback controls, time until the pressure P rises and reaches the target pressure $P_O$ can be reduced. Time in a transient state, for example, time until the discharge pressure P is stabilized after the nozzle 27 is switched to another nozzle cannot be utilized for cleaning, deburring, peeling and others work. However, in a cleaning device using the pumping system 10, time except work (time which cannot be utilized for work) can be reduced by the above-mentioned action.

As the pumping system 10 performs feedforward compensation, a delay of a response of the discharge pressure P at the beginning of operation can be removed. Besides, the pumping system 10 can match with a target value in a transient state in activating the piston pump 13 and in switching the used nozzle 27 to another one for example.

The pumping system 10 estimates the abrasion loss of the nozzle 27 and can instruct the display unit 48 to display it. That is, the pumping system 10 checks a situation of the abrasion of the nozzle 27 and can inform of the right time to replace the nozzle 27. A manager of the pumping system 10 can plan the replacement of the nozzles 27 according to the abraded loss of the nozzle 27. It is enabled at the first time by this embodiment to estimate the abrasion loss of the nozzle 27 and to inform of it. The abrasion of the nozzle 27 distorts the jet of the nozzle. Accordingly, when the abrasion proceeds, a jet is disturbed and cleaning effect is deteriorated. As the pumping system 10 displays the converted jet hole diameter d, the manager can suitably replace the nozzles 27 as the converted jet hole diameter d extends. The manager can hold cleaning effect highly by adjusting nozzle replacing time.

(First Modification)

This modification is similar to the above-mentioned embodiment in that a type of a nozzle 27 to which a tool number n is allocated and a reference jet hole diameter $d_O$ of the nozzle 27 are determined, however, this modification is different from the above-mentioned embodiment in that the configuration of a control parameter when pressure can be freely varied on the way of a cleaning program is provided.

FIG. 6A shows a table 55 showing target pressure $P_O$ for the nozzle 27 of the tool number n. A column 71 shows the tool number n. A column 72 shows the target pressure $P_O$ of the nozzle 27 corresponding to the tool number n. When no nozzle 27 is allocated to the tool number n, a specific character string (for example, x) is input in the column 72. CPU 45 reads whether the nozzle 27 is allocated to the selected tool number n or not based upon contents written in the column 72, and reads the target pressure $P_O$ of the nozzle 27.

FIG. 6B shows a table 56 provided every tool number n. The table 56 respectively shows a lower limit frequency $f_{MIN}$ and an upper limit frequency $f_{MAX}$ for the target pressure $P_O$ (see a column 73) of each nozzle 27 in a column 75 and a column 76. A normal range of the frequency f every target pressure $P_O$ is different depending upon a type of the nozzle 27 and a reference jet hole diameter $d_O$. Pressure control can be flexibly made by showing the normal range every target pressure $P_O$ for the tool number n in the table 56 even if the target pressure $P_O$ is changed according to cleaning work by a program for example.

FIG. 6C shows a table 57 provided every tool number n. A column 77 shows a type of data and a column 78 shows a value of the data. The table 57 shows a proportional gain $K_P$, integral time $T_I$, derivative time $T_D$ and a transfer function $C_1$ for the tool number n. It is desirable from a viewpoint of enhancing precision that the transfer function $C_1$ related to a PID parameter and frequency conversion has a different value every nozzle 27. The table 57 enables utilizing suitable control parameters corresponding to the tool number n by holding respective parameters (data) every nozzle 27.

In the first modification, the target pressure $P_O$ varies according to the preset order of cleaning.

In such configuration, input from a numerical control program of a numerical control unit can be utilized for the target pressure $P_O$ every nozzle in place of input from an input unit 46 or an input port 49. As control parameters and a normal frequency range every nozzle 27 are provided, the suitable parameter for the tool number n can be adopted. As the control parameter according to the target pressure $P_O$ can be selected every nozzle 27 when the nozzle 27 is determined for the tool number n, pressure control having high responsibility can be acquired. Accordingly, pressure regulation having good traceability is possible according to the order of cleaning programmed in the numerical control program even if the target pressure $P_O$ is suitably changed. As a control method and others are the same as those in the above-mentioned embodiment, their detailed description is omitted.

(Second Modification)

In a second modification, a control parameter is acquired based upon a type of a nozzle 27, a reference jet hole diameter $d_O$ of the nozzle 27 and target pressure $P_O$ and is stored in a storage 51.

In the second modification, even if the type of the nozzle 27 and the jet hole diameter are changed for a tool number n, a controllable pumping system 10 is provided by only setting the type of the nozzle 27, the reference jet hole diameter $d_O$ of the nozzle 27 and the target pressure $P_O$. The same reference numeral is allocated to the same configuration as that in the above-mentioned embodiment and detailed description is omitted.

FIGS. 7A, 7B, 7C show control parameters in this modification. As shown in FIG. 7A, a storage 51 stores various set values in a table 96. In the table 96, a column 82 includes a type of the nozzle 27 for the tool number n in a column 81, a column 83 includes the reference jet hole diameter $d_O$ [mm], and a column 84 includes the target pressure $P_O$ [MPa]. A user inputs data of the nozzle 27 attached to a turret device 25 in the table 96.

As shown in FIG. 7B, the storage 51 stores functions for acquiring control parameters corresponding to various nozzles 27 the use of which is supposed beforehand in a table 97. A column 85 includes the types of the nozzles 27. The types of the nozzles 27 are classified into a downward nozzle, a rotary nozzle, a transverse nozzle, a spray lance nozzle and others depending upon the contour of the nozzle and a direction of jet. A column 87 includes functions $F_{1KP}$, $F_{2KP}$, . . . of a proportional gain $K_P$ using the reference jet hole diameter $d_O$ of every type of the nozzles 27 and the target pressure $P_O$ for an argument. A column 88 includes functions $F_{1TI}$, $F_{2TI}$, . . . of integral time $T_I$ using the reference jet hole diameter $d_O$ and the target pressure $P_O$ for an argument. A column 89 includes functions $F_{1TD}$, $F_{2TD}$, . . . of derivative time $T_D$ using the reference jet hole diameter $d_O$ and the target pressure $P_O$ for an argument. A column 86 includes functions $F_{1C1}$, $F_{2C1}$, of a transfer function $C_1$ using the reference jet hole diameter $d_O$ and the target pressure $P_O$ for an argument. A column 91 includes functions $F_{dn1}$ $F_2$, . . . of a converted jet hole diameter d using a frequency f and discharge pressure P for an argument.

CPU 45 selects a row of the table 97 based upon the type of the nozzle 27 input in the table 96. Next, the CPU 45 assigns the reference jet hole diameter $d_O$ and the target pressure $P_O$ respectively input in the table 96 to the respective functions on the selected row and calculates the proportional gain $K_P$, the integral time $T_I$, the derivative time $T_D$ and the transfer function $C_1$ which are respectively the control parameters.

As shown in FIG. 7C, a table 98 is a list of various control parameters for the tool number n. A column 90 includes the tool number n, a column 92 includes the proportional gain $K_P$, a column 93 includes the integral time $T_I$, a column 94 includes the derivative time $T_D$, and a column 99 includes the transfer function $C_1$. The CPU 45 inputs respective values of the proportional gain $K_P$, the integral time $T_I$, the derivative time $T_D$ and the transfer function $C_1$ respectively calculated for the tool number n in the table 98.

The CPU 45 of a controller 43 controls a pumping system 10 based upon the numerical values input in the table 98. As a method of control is similar to that in the above-mentioned embodiment, its detailed description is omitted.

The CPU 45 operates the converted jet hole diameter d corresponding to the commanded frequency f based upon the functions in the column 91 (see the table 97 shown in FIG. 7B). The operated converted jet hole diameter d is displayed on a display unit 48. When the converted jet hole diameter d reaches 110% for example of the reference jet hole diameter $d_O$, the CPU 45 issues warning via a warning unit 47. Naturally, this scale factor can be suitably changed.

A parameter configuration and a process of operation in the above-mentioned embodiment can be changed and the pumping system 10 can be configured. For example, an upper limit frequency $f_{MAX}$ and a lower limit frequency $f_{MIN}$ may be also omitted in a system that enables the operation of a converted jet hole diameter d. When warning for the abrasion of the nozzle is not required, these functions can be all omitted. Conversely, when follow-up is more to be enhanced, a function using the target pressure $P_O$ and the converted jet hole diameter d which is an estimated value of the current jet hole diameter of the nozzle 27 for an argument can be added to the column 78 in the table 57 (see FIG. 6C). Such a system can control utilizing the more proper parameters for the converted jet hole diameter d which is the estimated value of the current jet hole diameter of the nozzle 27 and the target pressure $P_O$.

Besides, in the above-mentioned embodiment, the CPU 45 feeds the discharge pressure P back so as to match the discharge pressure P as a discharge characteristic with the target pressure $P_O$ and controls the rotational speed N of the permanent-magnet type synchronous motor 16, however, the present invention is not limited to this. As the discharge pressure and the discharge flow rate of the positive-displacement pump are in predetermined relation, the discharge flow rate may be also used for the discharge characteristic. That is, the CPU 45 feeds the discharge flow rate back using a control parameter corresponding to the selected nozzle 27 so as to match the discharge flow rate with a target value and may also control the rotational speed N of the permanent-magnet type synchronous motor 16.

Further, the controller 43 can set initial rotational speed (or an initial frequency) according to the nozzle number n. Until the discharge pressure P of the piston pump 13 exceeds a predetermined threshold after the nozzle number n is selected, the permanent-magnet type synchronous motor 16 can be rotated at the predetermined initial rotational speed. In this case, when the discharge pressure P of the piston pump 13 exceeds the threshold, feedback control is started according to the discharge pressure P and the control parameter. The threshold is set to a value equivalent to 90% of the target pressure $P_O$ for example. Until the discharge pressure P reaches the threshold after the nozzle number n is selected, effect that a rise of the pressure P is accelerated is made by rotating the permanent-magnet type synchronous motor 16 at the predetermined initial rotational speed. As the rise of the pressure P is accelerated, substantially usable cleaning time can be secured to be long. Besides, as deviation $P_{DEF}$ is small in the start of the feedback control, overshoot of the pressure P can be reduced when the feedback control is started. As the discharge pressure P is stable, the pumping system can be provided to keep work effect constant by a jet.

What is claimed is:

1. A pumping system that pressurizes fluid and jets the fluid from a nozzle selected out of a plurality of nozzles, the pumping system comprising:

a positive-displacement pump provided with a discharge opening for discharging the fluid;

a motor that drives the positive-displacement pump and has a rotational speed that is variable;

a selecting arrangement provided with an inlet of the fluid and a plurality of outlets, the selecting arrangement selecting the nozzle out of the plurality of nozzles and providing communication of the fluid between the inlet and an outlet among the plurality of outlets;

a discharge pipe providing communication of the fluid between the discharge opening and the inlet;

a storage that stores (i) control parameters used for control of the rotational speed and (ii) a target value of a discharge characteristic which is a discharge pressure or a discharge flow rate of the positive-displacement pump corresponding to each of the plurality of nozzles;

a sensor which is provided to the discharge pipe, the sensor measuring the discharge characteristic of the positive-displacement pump;

an exhaust valve provided to a pipe branched from the discharge pipe; and a processor that is programmed to:

control the rotational speed of the motor using (i) the stored control parameters corresponding to the nozzle selected by the selecting arrangement and (ii) the measured discharge characteristic of the positive-displacement pump that is fed back, so as to match the measured discharge characteristic with the target value; and keep the rotational speed of the motor at a preset idling rotational speed when the exhaust valve is open or when no nozzle is selected by the selecting arrangement.

2. The pumping system according to claim 1, further comprising:

a frequency converter that converts a frequency of ac power supplied to the motor, wherein:

the motor is an AC motor; and the processor is further programmed to:

perform PID control of the frequency of the ac power supplied by the frequency converter based upon a deviation between the measured discharge characteristic and the target value.

3. The pumping system according to claim 1, wherein:

the positive-displacement pump is a gear pump or a piston pump; and the motor is a permanent-magnet type synchronous motor.

4. The pumping system according to claim 1, further comprising:

a warning unit that issues a warning related to the nozzle, wherein:

when the rotational speed of the motor determined by a frequency of power supplied to the motor is equal to or greater than an upper limit rotational speed for the nozzle that is determined by an upper limit frequency preset for the nozzle, the warning unit issues the warning related to the nozzle.

5. The pumping system according to claim 1, further comprising:

a display unit that displays information, wherein:

the storage stores information for relating a rotational speed of the motor and a jet hole diameter of a nozzle for every nozzle; and the processor is further programmed to:

acquire a rotational speed of the motor for the nozzle selected by the selecting arrangement;

estimate a jet hole diameter of the nozzle corresponding to the acquired rotational speed based upon the relating information; and instruct the display unit to display the estimated jet hole diameter.

6. The pumping system according to claim 1, wherein the processor is further programmed to perform:

a feedback control that controls the rotational speed of the motor using the measured discharge characteristic that is fed back, so as to match the measured discharge characteristic with the target value; and a feedforward control that controls the rotational speed of the motor according to the target value.

7. The pumping system according to claim 1, wherein:

the target value varies according to a preset order of cleaning specifying an order in which at least two of the plurality of nozzles are used.

8. The pumping system according to claim 1, wherein:

the control parameters stored in the storage are acquired based upon a type of a nozzle, a reference jet hole diameter of a nozzle, and a target value for each of the plurality of nozzles.

9. The pumping system according to claim 1, wherein:

the storage stores an initial rotational speed corresponding to the target value of the discharge characteristic for the nozzle selected by the selecting arrangement; and the processor is further programmed to:

instruct the motor to rotate at the initial rotational speed when a jet of the fluid from the nozzle is started; and when the measured discharge characteristic exceeds a preset threshold, control the rotational speed of the motor using the measured discharge characteristic that is fed back.

* * * * *